US008387787B1

(12) United States Patent
Cvjetkovic et al.

(10) Patent No.: US 8,387,787 B1
(45) Date of Patent: Mar. 5, 2013

(54) TOILET SEAT COVER REFILL PACKAGE

(75) Inventors: Niko Anthony Cvjetkovic, La Palma, CA (US); Charles Parkin Davis, Torrance, CA (US); Patrick C. Perrin, Rancho Palos Verdes, CA (US)

(73) Assignee: Dispensing Dynamics International, City of Industry, CA (US)

( * ) Notice: Subject to any disclaimer, the term of this patent is extended or adjusted under 35 U.S.C. 154(b) by 543 days.

(21) Appl. No.: 12/455,123

(22) Filed: May 27, 2009

(51) Int. Cl.

| | |
|---|---|
| ***B65D 69/00*** | (2006.01) |
| ***B65D 73/00*** | (2006.01) |
| ***B65D 1/24*** | (2006.01) |
| ***B65D 25/04*** | (2006.01) |

(52) U.S. Cl. .... 206/233; 206/494; 220/557; 229/120.16

(58) Field of Classification Search ..... 211/26, 211/45, 47; 220/557, 26, 45, 47; 229/120.16, 229/87.01; 4/244.1; 206/215, 233, 449, 206/494, 521.3, 521.4, 521.5, 555
See application file for complete search history.

(56) References Cited

U.S. PATENT DOCUMENTS

| | | | | | |
|---|---|---|---|---|---|
| 1,479,018 | A | * | 1/1924 | Warren | 206/459.5 |
| 1,686,458 | A | * | 10/1928 | McColl | 206/494 |
| 2,153,279 | A | * | 4/1939 | Shelley | 4/244.1 |
| 2,537,741 | A | * | 1/1951 | Clark | 221/46 |
| 3,138,283 | A | * | 6/1964 | Peebles | 220/557 |
| 3,212,636 | A | * | 10/1965 | Bennett | 206/433 |
| 3,285,493 | A | * | 11/1966 | Coe et al. | 229/120.16 |
| 3,945,557 | A | * | 3/1976 | Graham, Jr. | 229/120.24 |
| 4,264,992 | A | * | 5/1981 | Tromp | 4/244.1 |
| 4,967,909 | A | * | 11/1990 | McKibben | 206/556 |
| 5,630,658 | A | * | 5/1997 | Jeter | 312/107 |
| 5,695,065 | A | * | 12/1997 | Kennedy et al. | 206/554 |

* cited by examiner

*Primary Examiner* — J. Gregory Pickett
*Assistant Examiner* — Kaushikkumar Desai
(74) *Attorney, Agent, or Firm* — Thomas R. Lampe

(57) ABSTRACT

A toilet seat cover refill package including a box holding a plurality of toilet seat covers dispensed in face-to-face relationship and on end, and support structure within the box for providing lateral support for the toilet seat covers to prevent sagging thereof.

13 Claims, 5 Drawing Sheets

TOILET SEAT COVER REFILL PACKAGE

TECHNICAL FIELD

This invention relates to the dispensing of toilet seat covers and more particularly to a toilet seat cover refill package for use with toilet seat cover dispensers.

BACKGROUND OF THE INVENTION

It is well known to provide dispensers for tissue toilet seat covers in restrooms, particularly, but not exclusively, in restrooms available to the public. While tissue toilet seat covers have been available in rolls with the cover separated by frangible connector lines, toilet seat covers currently are more typically in the form of individual sheets of tissue folded and stacked in a dispenser, the stack being vertically oriented in the dispenser. The individual toilet seat covers are manually pulled and dispensed through an opening in the dispenser.

The stack of folded toilet tissue seat covers is commonly disposed in a refill box or container placed in a dispenser cabinet. Existing seat cover dispensers utilize an industry standard refill package that contains 250 seat covers. Some dispensers can hold a single 250 pack refill package while others can hold two of the standard 250 pack refill packages.

Large packages holding more than the 250 count stacks of toilet seat covers create a dispensing problem as the refill package empties. During emptying of a large capacity refill package, the seat covers remaining therein can sag enough that the leading edge of the seat cover is below the dispensing openings of the refill package box and the cabinet. This makes it more difficult for the end user to manually extract just a single seat cover, resulting in waste.

DISCLOSURE OF INVENTION

This invention relates to a toilet seat cover refill package which incorporates structure inhibiting sagging of toilet seat covers remaining therein even when the stack is virtually fully depleted by dispensing.

The toilet seat cover refill package of the invention includes a toilet seat cover box holding a plurality of double-sided flexible toilet seat covers disposed in face-to-face relationship and on end in a substantially vertical orientation for individually dispensing the toilet seat covers.

The box has front and back walls, end walls connecting the front and back walls, a top and a bottom. The front and back walls, the end walls and the top and bottom define a box interior.

The front wall defines a dispensing opening communicating with the box interior and positioned to expose an upwardly directed end portion of a forward-most toilet seat cover of the plurality of toilet seat covers.

Support structure is located within the box interior for providing lateral support for toilet seat covers within the box interior to inhibit sagging thereof within the box interior and maintain the upwardly directed end portions thereof positioned for manual access and dispensing through the dispensing opening.

Other features, advantages and objects of the present invention will become apparent with reference to the following description and accompanying drawings.

MODES FOR CARRYING OUT THE INVENTION

Figure 1:
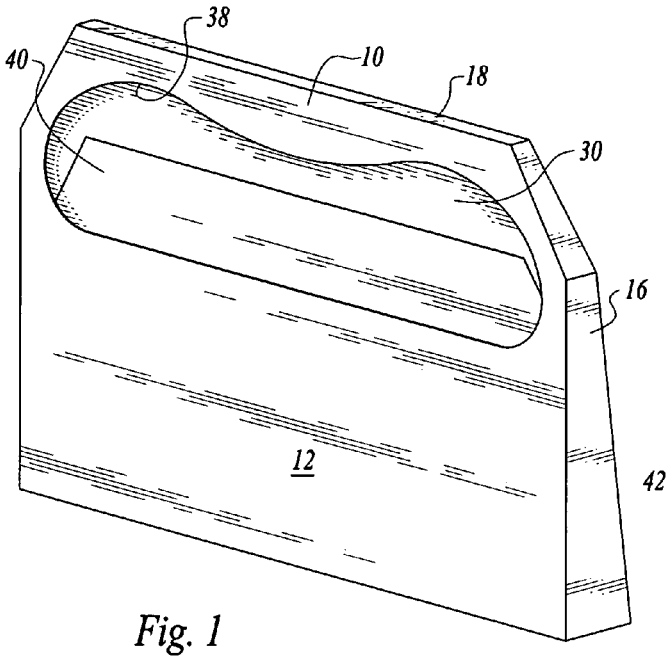
FIG. 1 is a frontal, perspective view of a toilet seat cover refill package constructed in accordance with the teachings of the present invention.
Figure 2:
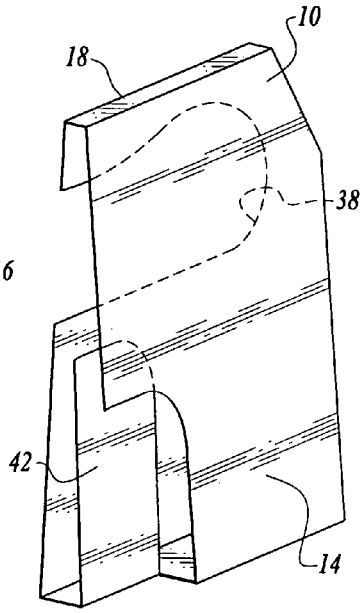
FIG. 2 is a back, perspective, sectional view illustrating a portion of the box and support structure of the package, the toilet seat covers not being shown for clarity purposes.
Figure 3:
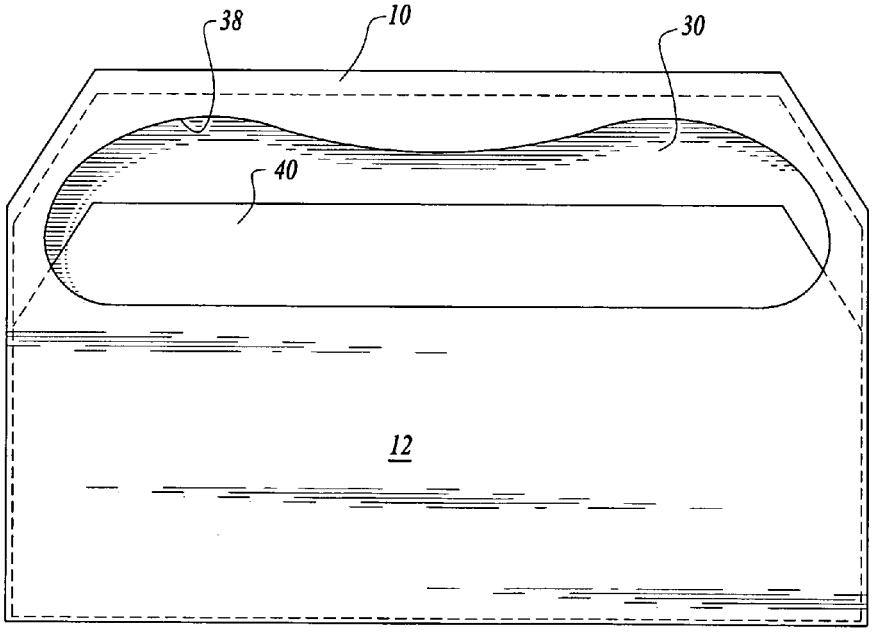
FIG. 3 is a front, elevational view of the toilet seat cover refill package and illustrating an upwardly directed end portion of a forward-most toilet seat cover accessible through a dispensing opening in the toilet seat cover package box.

Referring now to FIGS. 1-8 and 12, a toilet seat cover refill package constructed in accordance with the teachings of the present invention is illustrated. In the drawing and specification hereof, embodiments of the invention are illustrated and described in the customary use orientation employed for toilet seat cover refill packages generally, that is, with the toilet seat cover refill package oriented so upper end portions of the toilet seat covers extend vertically upwardly and the leading edges of the upper end portions are disposed horizontally. Certain terms, such as "top", "bottom", "vertical", "horizontal", "upwardly" and "downwardly", are or may be used to describe and claim the structural elements of the toilet seat cover refill package and their cooperative relationships based on this normal and conventional orientation. Toilet seat cover dispensers and consequently the toilet seat refill packages utilized therewith which are oriented in some other manner, as by being tilted, or disposed up-side down, fall within the spirit and scope of this invention as claimed.

Figure 12:
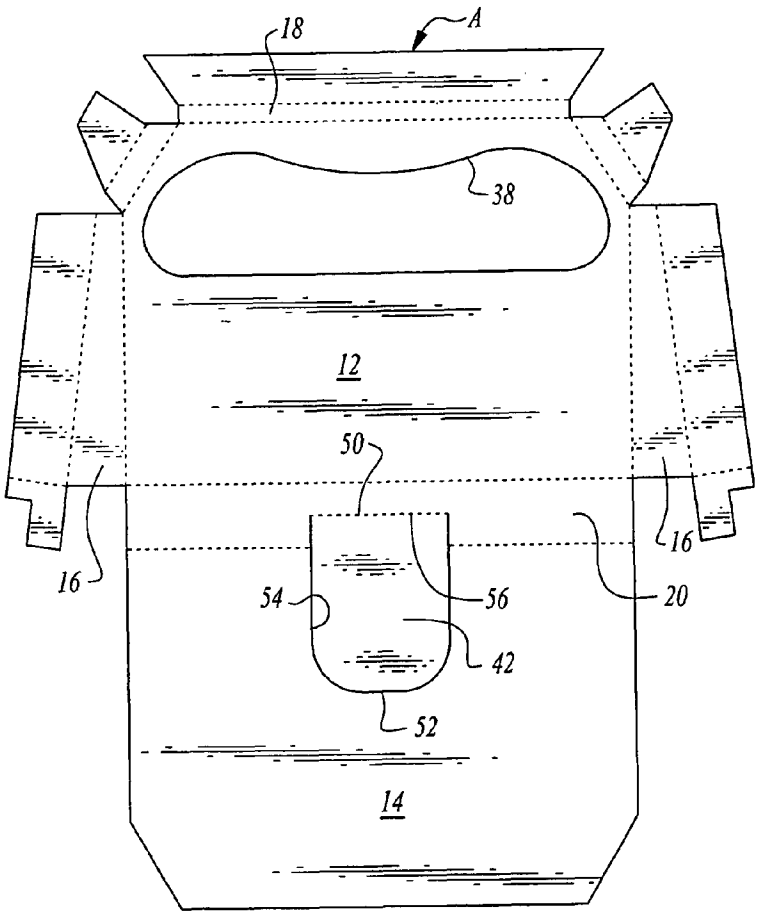
FIG. 12 is a plan view illustrating a box blank utilized to construct the toilet seat cover box and support structure of the refill package embodiment shown in FIGS. 1-8.
Figure 11:
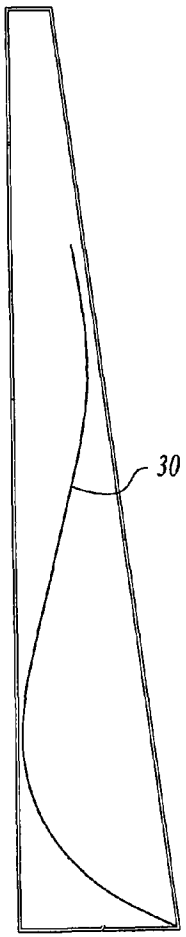
Fig. 11 (Prior Art)
FIGS. 10 and 11 are views of a prior art toilet seat cover refill package which correspond to FIGS. 7 and 8, but illustrate the condition of a single toilet seat cover within a large capacity box when unsupported by support structure.

The toilet seat cover refill package of the present invention includes a toilet seat cover box 10 holding a plurality of double-sided, flexible seat covers disposed in face-to-face relationship and on end in a substantially vertical orientation for individually dispensing the toilet seat covers. The box 10 may be formed of any suitable material such as paperboard. FIG. 12 illustrates a flat paperboard blank A which may be utilized upon bending and assembly thereof to form the toilet seat cover box 10. The box has a front wall 12, a back wall 14, end walls 16 connecting the front and back walls, a top 18 and a bottom 20, the walls, top and bottom defining a box interior.

Figure 5:
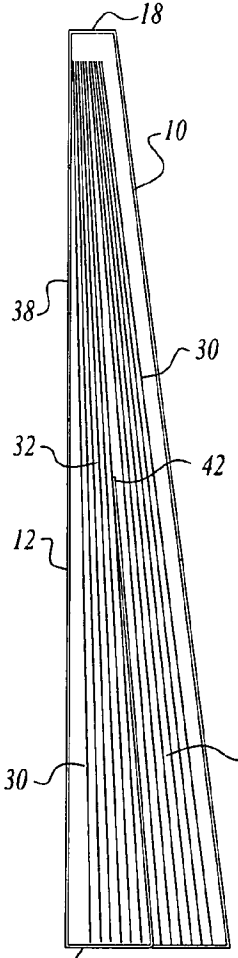
FIG. 5 is a side, elevational, cross-sectional view illustrating the interior of the box, a plurality of toilet seat cover covers therein and a partition separating the toilet seat covers into a front group and a back group thereof.
Figure 4:
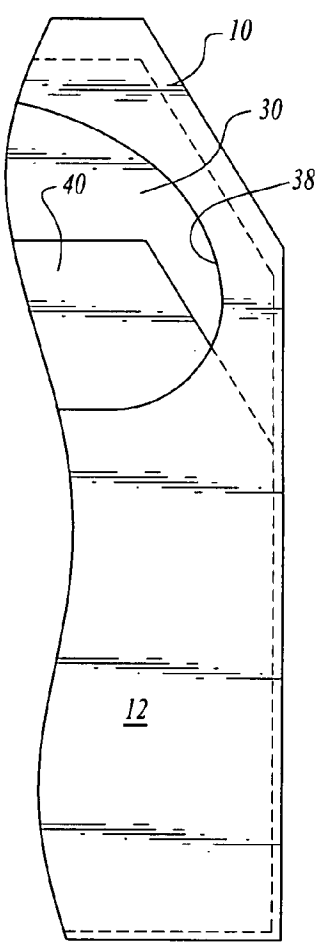
FIG. 4 is a front, elevational view of an end portion of the package illustrating by solid and dash lines normal positioning of a toilet seat cover within the package box.

Prior art refill boxes having the general configuration of box 10 are known, such boxes, as stated above, normally able to accommodate at most 250 toilet seat covers. The box 10 differs from prior art arrangements by virtue of the fact that the end walls may be about twice as wide as compared to prior art boxes and may contain, for example, around 500 toilet seat covers disposed in face-to-face relationship. FIG. 5 illustrates in schematic fashion a stack which may consist of, for example, 500 toilet seat covers, the toilet seat covers being identified by reference numeral 30. In FIG. 5 the stack of toilet seat covers 30 is divided into a front group 32 and a back or rear group 34 by a partition 42 which will be described in more detail below.

Figure 10:
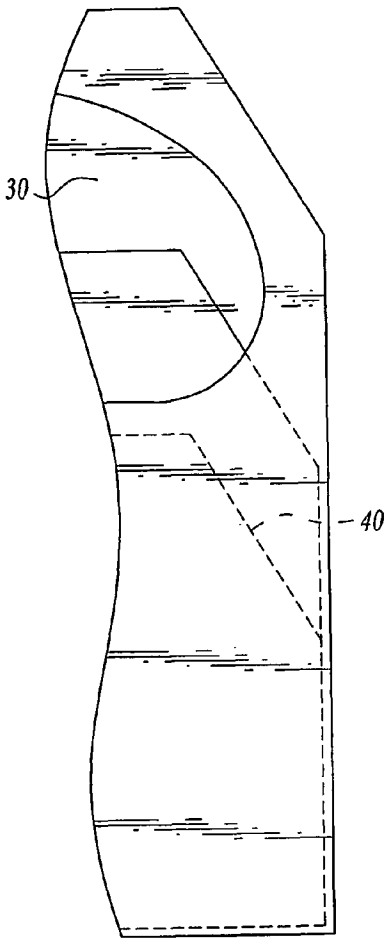
Fig. 10 (Prior Art)

The front wall 12 defines a dispensing opening 38 communicating with the box interior. The dispensing opening 38 is positioned to expose an upwardly directed end portion 40 of a forward-most toilet seat cover 30 of the plurality of toilet seat covers in the box interior. As is conventional, this upwardly directed end portion 40 is utilized by a consumer to extract a toilet seat cover from the dispensing opening and of course through a dispensing opening communicating therewith of a dispenser cabinet (not shown). If the upwardly directed end portion 40 falls below the dispensing opening, as shown in FIG. 10 illustrating this condition in the prior art, the user has a difficult time grasping just one sheet cover, resulting in waste. The dispensing opening 38 has the shape of a dispensing opening disclosed in U.S. patent application Ser. No. 12/383,540, filed Mar. 25, 2009, but the principles of the present invention are applicable to toilet seat cover refill packages and dispenser cabinets having any suitable dispensing opening shape.

Support structure is disposed within the box interior for supporting toilet seat covers 30 within the box interior to inhibit sagging thereof within the box interior and maintain the upwardly directed end portions 40 thereof positioned for manual access and dispensing through the dispensing opening 38. In the embodiment under discussion, the support structure is a partition 42 which, as shown in FIG. 5 for example, extends upwardly from the bottom 20 about midway between the front wall 12 and back wall 14 to divide the toilet seat covers in the filled box into front group 32 and rear group 34, the size of the groups normally being approximately equal when the box is in loaded condition.

The partition 42 has a partition front surface 44 and a partition back surface 46 and is disposed between toilet seat 30 covers with the partition front surface and the partition back surface extending upwardly alongside and between adjacent toilet seat covers, the partition front and back surfaces engaging the adjacent toilet seat covers.

The partition 42 has a proximal end 50 and a distal end 52. In the arrangement illustrated, the proximal end 50 is attached to the bottom 20 at a location between and spaced from the front wall and the rear wall. The partition 42 is planar, with the proximal and distal ends extending substantially parallel to the front and back walls 12, 14 and also to the sides of the toilet seat covers.

Figure 6:
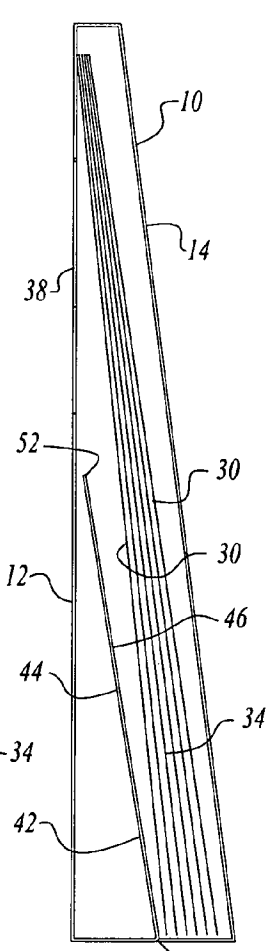
FIG. 6 is a view similar to FIG. 5, but illustrating the front group of the toilet seat covers having been dispensed and toilet seat covers of the back group remaining in place and prior to dispensing thereof.

The partition is pivotally mounted at the bottom and movable between the upright position show in FIG. 5 to an inclined position shown in FIG. 6 wherein the distal end is closer to the front wall 12 than to said back wall 14. Contact with the front wall will limit the degree of forward inclination of the partition.

In the disclosed embodiment, the partition 42 is in the form of a flap integral with and formed from the bottom 20 and back wall 14. FIG. 12 shows the flap or partition 42 defined by a line of cut 54 and a fold line 56. When the box 10 is assembled, the flap 42 is folded so that it extends upwardly from the bottom as described above. In other words, the flap or partition 42 is integral with and formed from the bottom and the rear wall.

Figure 8:
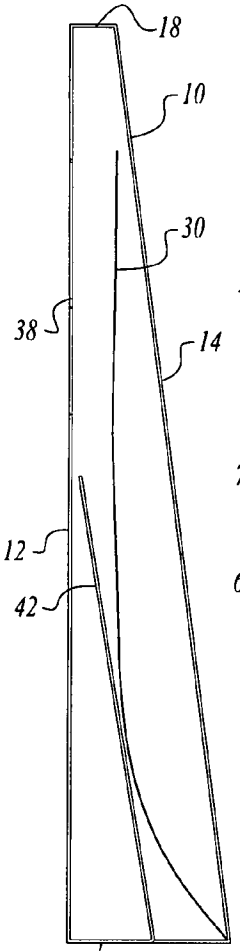
FIG. 8 is a view similar to FIGS. 5 and 6, but illustrating support structure in the form of a partition inhibiting sagging of the remaining toilet seat cover, the toilet seat cover positioned as shown in FIG. 7 and remaining manually accessible through the dispensing opening.
Figure 7:
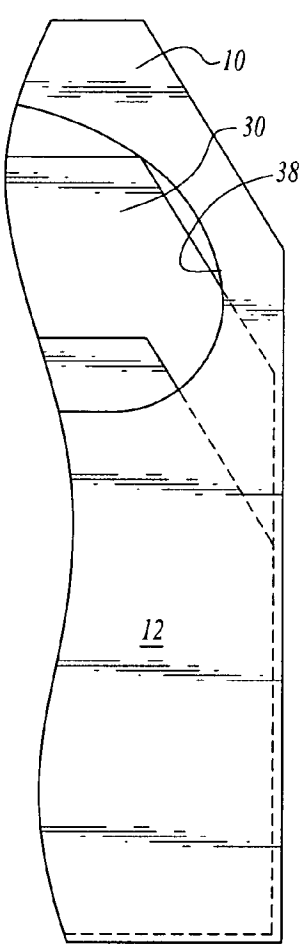
FIG. 7 is a view similar to FIG. 4, but illustrating the very last toilet seat cover of the second group within the box and maintained in a position within the box by support structure of the present invention to maintain the upwardly directed end portion thereof positioned for manual access and dispensing through the dispensing opening.

FIGS. 7 and 8 illustrate the flap being engaged by the last toilet seat cover to be dispensed to inhibit sagging thereof. It will be appreciated that if a sufficient number of toilet seat covers remain in rear group 34, as illustrated in FIG. 6, the stack of the rear group will have sufficient strength in and of itself to resist sagging or bending to a certain degree. The situation becomes much more critical as the numbers of toilet seat covers in the rear group are reduced. With regard to the situation shown in FIG. 5 where dispensing takes place from the front group 32, the front wall itself in cooperation with the partition 42 creates a space small enough that sagging of toilet seat covers in the front group is not a problem.

Figure 9:
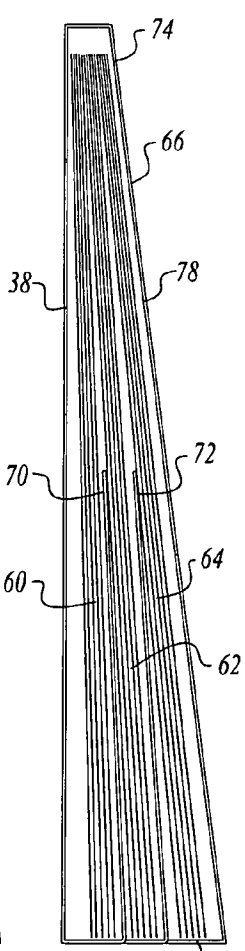
FIG. 9 is a view similar to FIG. 5 of an alternative embodiment of the invention incorporating two partitions to separate the full supply of toilet seat covers in the box into three groups.
Figure 13:
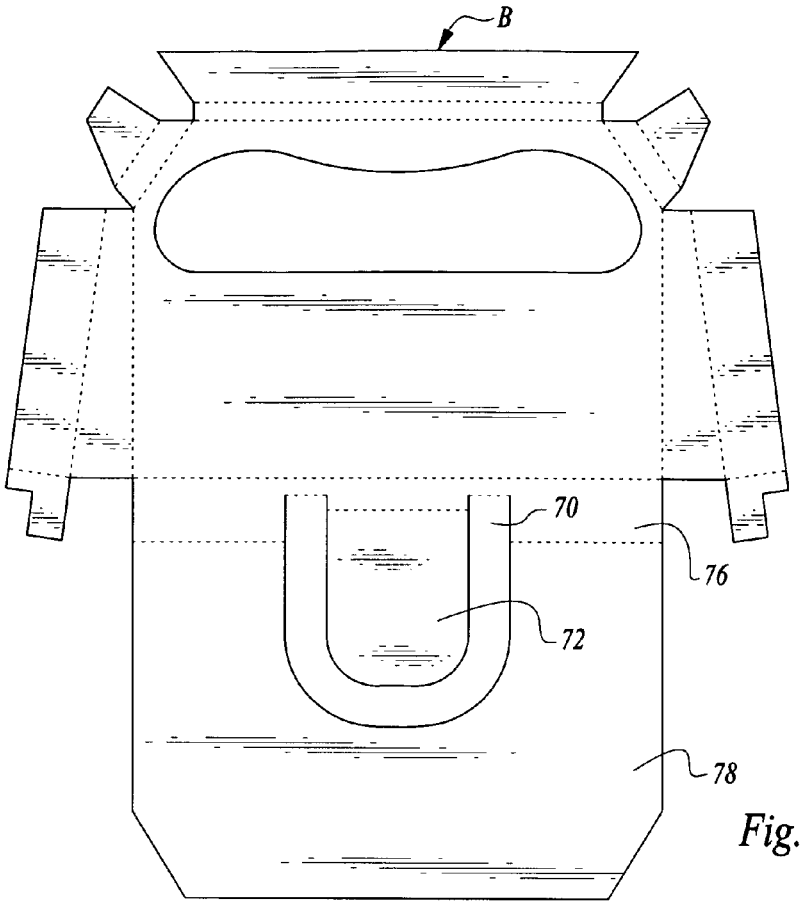
FIG. 13 is a plan view illustrating a box blank utilized to construct the toilet seat cover box and support structure of the refill package embodiment shown in FIG. 9.

FIGS. 9 and 13 illustrate another embodiment of the invention wherein two flaps or partitions are employed to separate the toilet seat covers in a full package 66 into three groups, a front group 60, a middle group 62 and a rear group 64.

The flaps 70 and 72 are formed from the bottom 76 and back wall 78 of box 74 of the toilet seat cover refill package 66. As may be seen with particular reference to the box blank B of FIG. 13, both flaps are pivotally connected to the bottom. The flaps are pivoted about their respective fold lines to the positions shown in FIG. 9. The toilet seat covers will be dispensed first from front group 60, then middle group 62, and finally from rear group 64. The flaps operate in the manner described above with respect to the flap of the first embodiment to provide lateral support for the toilet seat covers to inhibit sagging thereof.

Figure 14:
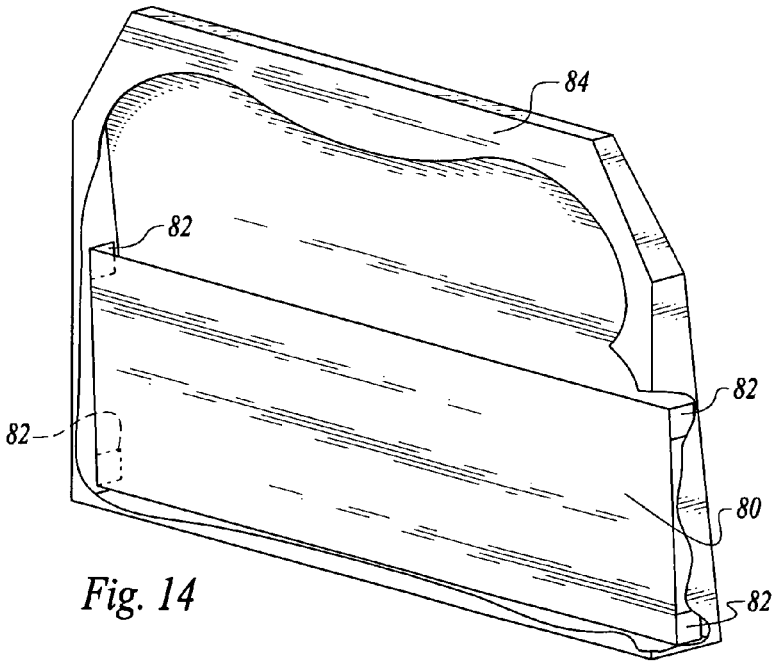
FIG. 14 is a front, perspective view of another embodiment of the invention, illustrating a portion of the toilet seat cover dispenser box broken away to show a partition with end tabs, the box interior not holding toilet tissue seat covers.
Figure 15:
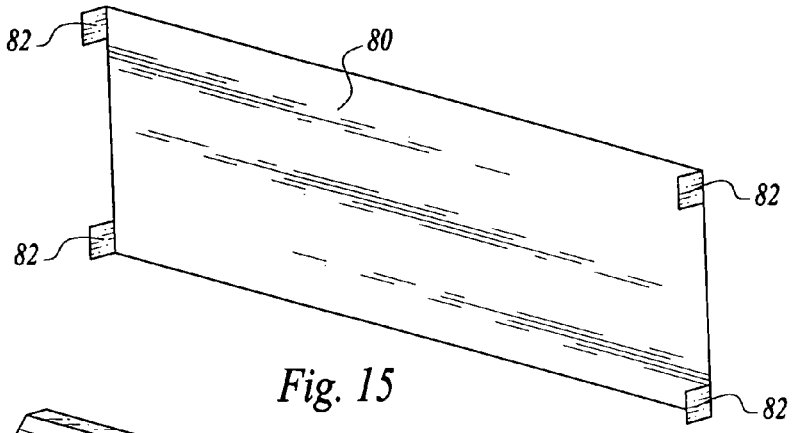
FIG. 15 is a perspective view of the partition and end tabs of the FIG. 14 embodiment.

Referring now to FIGS. 14 and 15, another embodiment of the invention is illustrated wherein support structure includes a partition 80 having support elements in the form of tabs 82 projecting laterally from the ends thereof disposed in box 84. The partition and tabs are of integral construction and not formed from the blank used to form box 84. The tabs are adhesively secured to the end walls of the box so that the partition doesn't pivot.

Figure 16:
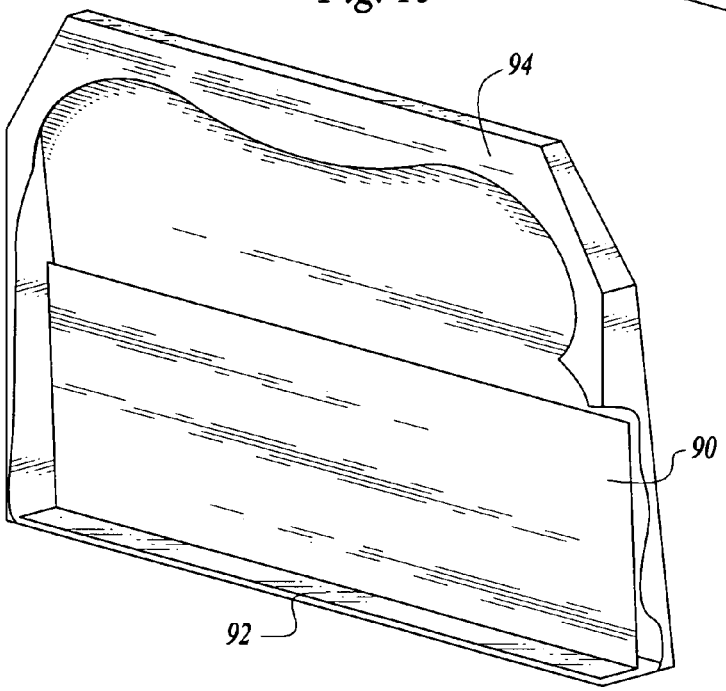
FIG. 16 is a front, perspective view of an additional embodiment, illustrating a partition and a flange attached to the bottom thereof.
Figure 17:
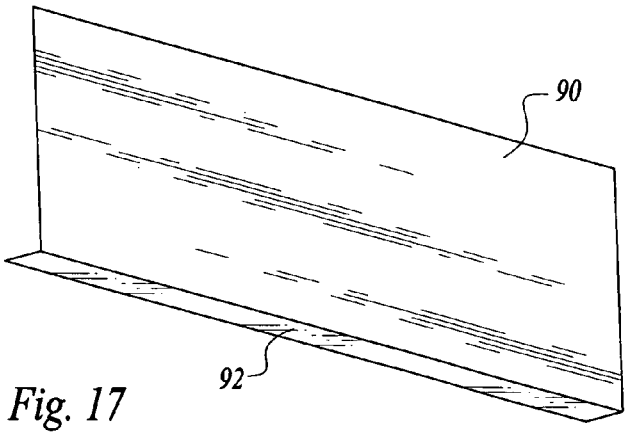
FIG. 17 is a perspective view of the partition and flange of the FIG. 16 embodiment.

FIGS. 16 and 17 illustrate yet another embodiment wherein a partition 90 having a support element in the form of flange 92 projecting laterally outwardly from the bottom thereof is disposed in the interior of box 94. The flange 92 may be secured to the bottom or may be unsecured so that the partition is allowed to "float."

Further, the partition and flange may be rigidly interconnected or the partition and flange may be connected along a fold line so that the partition can pivot.

The invention claimed is:

1. A toilet seat cover refill package comprising in combination:

a toilet seat cover box supporting and holding a plurality of unfolded groups of toilet seat covers including a first group and a second group behind said first group, each group comprising a plurality of individual double-sided flexible toilet seat covers having upper and lower ends, said toilet seat covers disposed in face-to-face relationship and supported on end by the box in a substantially vertical orientation for individually dispensing said toilet seat covers from said box, said box having front and back walls, end walls connecting said front and back walls, and a top and a bottom defining a box interior, with the lower ends of said toilet seat covers engaging said bottom, with said bottom supporting the toilet seat covers, and extending upwardly from said bottom toward said top between said front and back walls with the forward-most seat cover of said first group slidably engageable with said front wall and the toilet seat cover upper ends adjacent to the top of said box, each toilet seat cover having an upwardly directed end portion located between said top and said bottom, and said front wall defining a dispensing opening communicating with said box interior and positioned to serially expose the upwardly directed end portions of said plurality of toilet seat covers during dispensing thereof; and support structure extending upwardly from said bottom between and spaced from said front and back walls between said first group and said second group within said box interior simultaneously slidably engaging the rearward-most seat cover of said first group and the forward-most seat cover of said second group and cooperable with said front wall and said back wall to provide lateral support for the toilet seat covers within said box interior to inhibit sagging thereof within said box interior and support the toilet seat covers with the upwardly directed end portions thereof positioned for consecutive manual access and dispensing through said dispensing opening, said support structure including a partition extending between said first and second groups of toilet seat covers alongside and in simultaneous engagement with the rearward-most seat cover of said first group and the forward-most seat cover of said second group, said partition having a proximal end and a distal end, said proximal end pivotally attached to said bottom at a location between and spaced from said front wall and said back wall and said partition pivotally moveable about said location responsive to dispensing and depletion of the toilet seat covers in said first group from substantially vertical orientation to an upwardly inclined orientation wherein said partition is inclined toward said front wall and said distal end is positioned closer to said front wall than to said rear wall, said partition when in said upwardly inclined orientation providing support for toilet seat covers of said second group to inhibit sagging thereof and maintain the upwardly directed end portions thereof positioned for manual access and dispensing through said dispensing opening upon depletion of the toilet seat covers of said first group.

2. The combination according to claim 1 wherein said partition is substantially planar, with said proximal and distal ends thereof extending between said end walls.

3. The combination according to claim 1 wherein said partition comprises a flap integral with and at least partially formed from said bottom.

4. The combination according to claim 1 wherein said support structure comprises a plurality of partitions spaced from one another.

5. The combination according to claim 3 wherein said flap is integral with and at least partially formed from said bottom and from said rear wall.

6. The combination according to claim 4 wherein each of said partitions comprises a flap.

7. The combination according to claim 1 wherein said support structure additionally includes at least one support element projecting outwardly from said partition and engageable with an interior surface of said box to provide support for said partition.

8. The combination according to claim 7 wherein said support element engages the bottom of said box.

9. The combination according to claim 8 wherein said support element is secured to said bottom.

10. The combination according to claim 7 wherein said support element is one of a plurality of support elements engaging opposed end walls of said box.

11. The combination according to claim 8 wherein said support element is a flange projecting laterally from a bottom end of said partition.

12. The combination according to claim 10 wherein said support elements comprise tabs projecting laterally from opposed ends of said partition.

13. The combination according to claim 1 wherein said partition is engageable with said front wall below said dispensing opening to limit the inclination of the partition.

* * * * *